US006030242A

United States Patent [19]

Cunningham et al.

[11] Patent Number: 6,030,242

[45] Date of Patent: Feb. 29, 2000

[54] SELF-CENTERING PANEL-MOUNTED CONNECTOR ASSEMBLY

[75] Inventors: Adam Douglas Cunningham, Methuen, Mass.; Kevin E. Walker, Hershey, Pa.

[73] Assignee: The Whitaker Corporation, Wilmington, Del.

[21] Appl. No.: 09/137,942

[22] Filed: Aug. 21, 1998

[51] Int. Cl.[7] ..... H01R 13/74

[52] U.S. Cl. ..... 439/247; 439/247; 439/248; 439/545

[58] Field of Search ..... 439/247, 248, 439/545

[56] References Cited

U.S. PATENT DOCUMENTS

| | | | |
|---|---|---|---|
| 3,912,355 | 10/1975 | Curado et al. | 339/128 |
| 3,995,947 | 12/1976 | Lightner et al. | 339/92 M |
| 4,029,385 | 6/1977 | Mysiak et al. | 339/128 |
| 4,029,953 | 6/1977 | Natoli | 240/8.16 |
| 4,077,693 | 3/1978 | Briel, Jr. et al. | 339/126 R |
| 4,148,542 | 4/1979 | Wood | 339/126 RS |
| 4,352,538 | 10/1982 | Fowler | 339/126 |
| 4,389,021 | 6/1983 | Coldren | 339/126 |
| 4,541,036 | 9/1985 | Landries et al. | 361/426 |
| 4,647,129 | 3/1987 | Kandybowski et al. | 339/64 |
| 4,647,130 | 3/1987 | Blair et al. | 339/64 M |
| 4,707,765 | 11/1987 | Ohashi | 361/401 |
| 4,761,144 | 8/1988 | Hunt, III et al. | 439/545 |
| 4,812,133 | 3/1989 | Fleak et al. | 439/248 |
| 4,824,387 | 4/1989 | Dejong et al. | 439/248 |
| 4,909,748 | 3/1990 | Kozono et al. | 439/247 |
| 4,921,426 | 5/1990 | Kawasaki et al. | 439/34 |
| 4,921,435 | 5/1990 | Kane et al. | 439/248 |
| 4,936,786 | 6/1990 | Klein et al. | 439/76 |
| 4,990,094 | 2/1991 | Chandler et al. | 439/108 |
| 5,002,497 | 3/1991 | Plocek et al. | 439/248 |
| 5,017,151 | 5/1991 | Peterson | 439/248 |
| 5,035,647 | 7/1991 | Schafer | 439/557 |
| 5,127,852 | 7/1992 | Cravens et al. | 439/545 |
| 5,184,964 | 2/1993 | Douty et al. | 439/247 |
| 5,228,865 | 7/1993 | Douty et al. | 439/247 |
| 5,407,363 | 4/1995 | Polgar et al. | 439/546 |
| 5,443,403 | 8/1995 | Weidler et al. | 439/701 |
| 5,514,000 | 5/1996 | Krause et al. | 439/248 |
| 5,525,074 | 6/1996 | Tsuji et al. | 439/555 |
| 5,575,673 | 11/1996 | Dahlem et al. | 439/248 |
| 5,620,329 | 4/1997 | Kidd et al. | 439/248 |
| 5,622,511 | 4/1997 | Jarrett | 439/248 |
| 5,795,185 | 8/1998 | Edgley et al. | 439/545 |
| 5,800,208 | 9/1998 | Ishizuka et al. | 439/557 |

*Primary Examiner*—Paula Bradley
*Assistant Examiner*—Truc Nguyen

[57] ABSTRACT

A connector assembly 20 including a housing 26 adapted for mounting to a panel 30 through a cutout 31 in the panel 30. The housing 26 is adapted for sliding engagement with the panel 30 when installed in the cutout 31. A centering mechanism 29 is coupled to the housing 26 and serves to substantially vertically center the housing 26 in the cutout 31 when the connector 20 is unmated with a complementary connector.

16 Claims, 4 Drawing Sheets

SELF-CENTERING PANEL-MOUNTED CONNECTOR ASSEMBLY

BACKGROUND OF THE INVENTION

1. Field of the Invention

This invention relates generally to panel-mounted electrical connectors and more particularly, to panel-mounted electrical connectors having a self-centering feature.

2. Description of the Related Art

Panel-mounted electrical connectors are commonly employed in many applications. For example, a computer system will typically include receptacle connectors mounted in a back panel and positioned so as to receive a mating plug connector attached to a printed circuit board or a component, for example, a hard disk drive. Various specifications have been promulgated within the electrical connector industry to standardize the electrical and physical interface between receptacles and plugs. One example of such a standard is known as the Device Bay Specification.

In many instances, when a computer system is manufactured, panel-mounted receptacles will be installed for which there is no corresponding printed circuit board or component in the system. The receptacles are installed to provide for future installation of boards or components. One problem that arises in that circumstance is the positioning of the receptacle in the panel such that it will align with a mating plug when the printed circuit board or other component is later installed. One common method for overcoming a potential alignment problem is to install the receptacle in a cutout in the panel where the dimension of the cutout exceeds the dimension of the receptacle, allowing the receptacle to move within the cutout. At least two issues arise by allowing the receptacle to "float" in the panel cutout. First, the amount of "float" by the receptacle in the cutout must be limited so that connection to a mating plug connector will be possible when the plug connector is at either extreme of its tolerance location. Second, attachment of the receptacle to the panel becomes problematic when attempting to maintain a "float" of the receptacle within the panel cutout.

The present invention is directed to overcoming, or at least reducing the effects of, one or more of the problems set forth above.

SUMMARY OF THE INVENTION

In one aspect of the present invention, a connector assembly is provided having electrical contacts adapted for interconnection with an electrical cable. The assembly includes a housing adapted for mounting to a panel through a cutout in the panel and further adapted for sliding engagement with the panel while maintaining the housing in the cutout. A centering mechanism is coupled to the housing and is adapted to substantially vertically center the housing in the cutout when the connection is unmated with a complementary connector.

In another aspect of the present invention, a connector includes a housing having a top surface, a bottom surface, a forward edge and a rear edge. A first retainer tab is coupled to the top surface of the housing adjacent the rear edge of the housing and a second retainer tab is coupled to the bottom surface of the housing adjacent the rear edge of the housing. A third retainer tab is coupled to the top surface of the housing and a fourth retainer tab is coupled to the bottom surface of the housing, gaps between the first and third retainer tabs and between the second and fourth retainer tabs are adapted to receive a panel for slidably mounting the housing. The cutout has a vertical dimension greater than a vertical dimension of the housing such that the housing is free to move vertically within the cutout. A spring is coupled to the housing and adapted for substantially vertically centering the housing in the cutout.

BRIEF DESCRIPTION OF THE DRAWINGS

The invention may be understood by reference to the following description taken in conjunction with the accompanying drawings, in which like reference numerals identify like elements, and in which.

Figure 1:
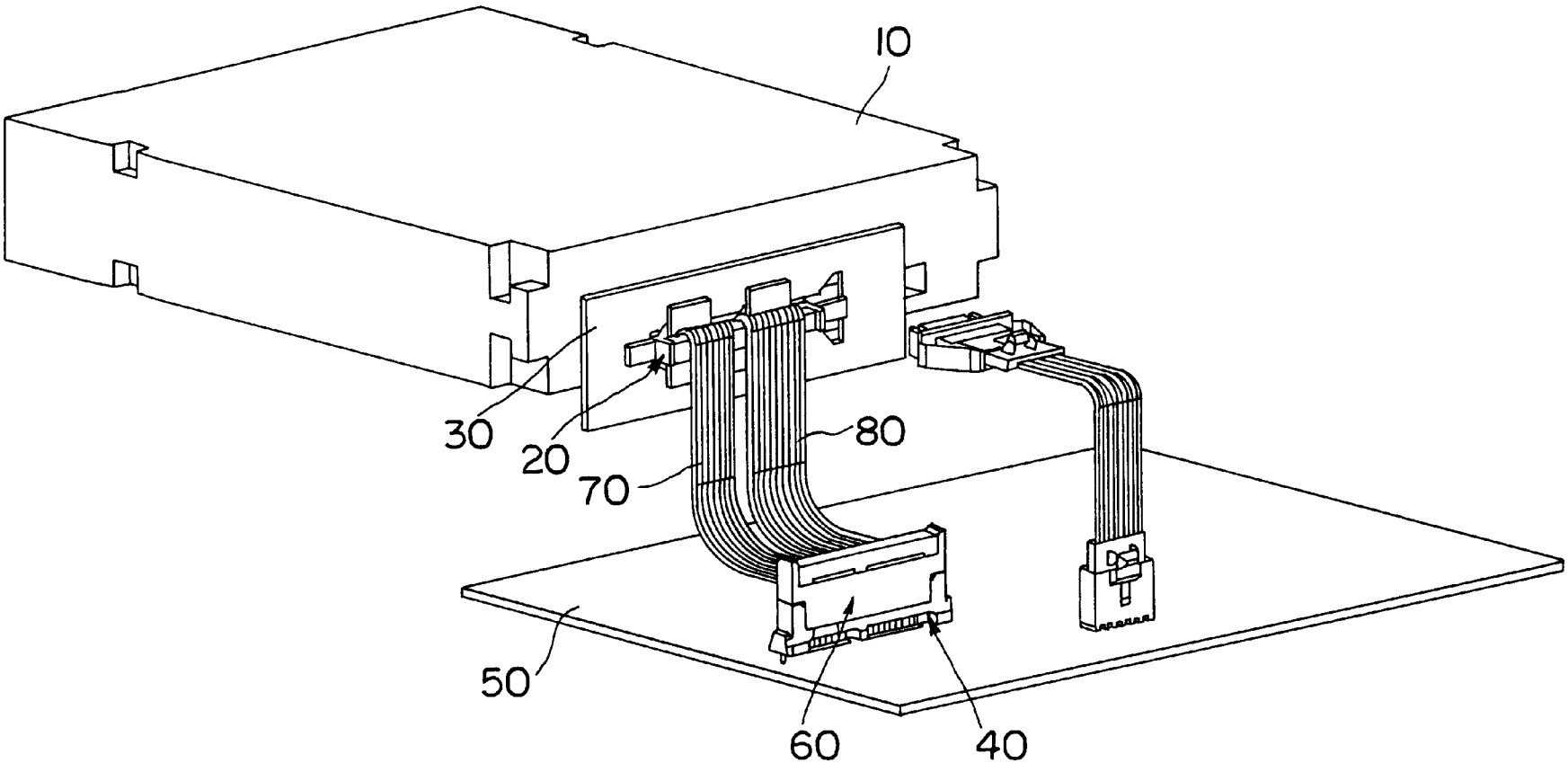
FIG. 1 is an isometric view of a connector assembly according to the present invention in use with a peripheral component of a computer system.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 shows one embodiment of a connector receptacle assembly 20 according to the present invention in use with a peripheral component 10 of a computer system. The receptacle assembly 20 is mounted into a panel 30 through a cutout 31 (see FIG. 2) in the panel 30. A vertical plug header 40 may be mounted on a printed circuit board 50, for example, for mating with a second cable receptacle 60. The receptacle assembly 20 is interconnected with the receptacle 60 by means of two flat cables 70 and 80 that are adapted to carry data signals and electrical power, for example. The receptacle assembly 20 is adapted to receive and mate with a connector plug (not shown) located at the rear of the component 10 when the component 10 is inserted into a computer frame of which the panel 30 may be a part. The connector receptacle assembly 20 described herein and shown in FIG. 1 complies with the Device Bay Specification, an industry specification championed by Compaq Computer Corporation, Intel Corporation and Microsoft Corporation. However, as will be appreciated, the invention may also be employed in connectors that do not comply with the Device Bay Specification. The invention will find usefulness with connectors having a variety of different electrical and physical arrangements.

Figure 2:
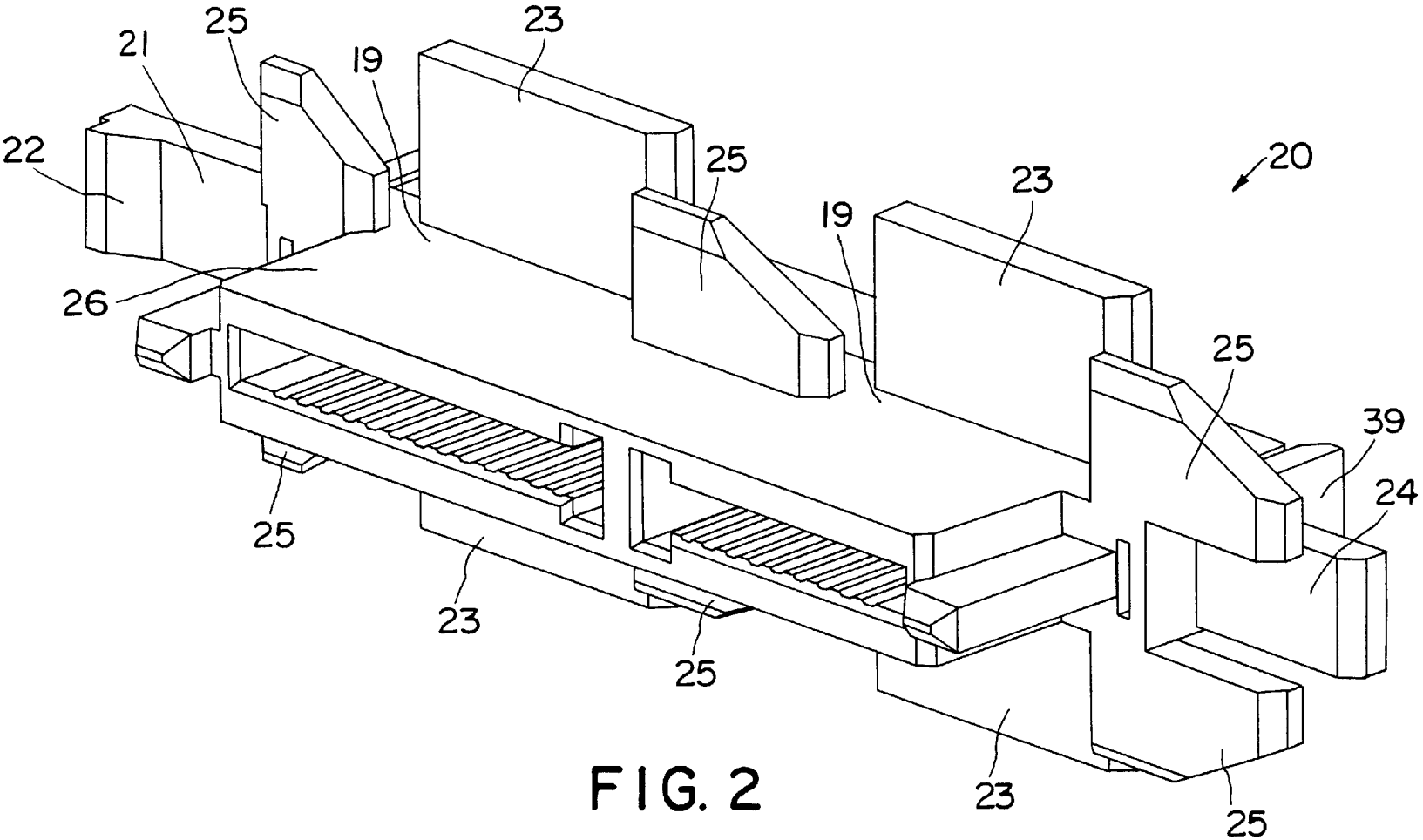
FIG. 2 is an isometric view from a front side of a connector according to the present invention.

FIG. 2 is a view of the receptacle assembly 20 of FIG. 1, viewed from the front of the assembly 20. As previously described in connection with FIG. 1, the receptacle 20 may be mounted into a panel 30 through a cutout 31 (see FIG. 3) in the panel 30. The cutout 31 will be described more specifically in connection with FIG. 5 below. The receptacle assembly 20 includes a housing 26 that protrudes through the cutout 31 when the receptacle assembly 20 is mounted into the panel 30 from the rear of the panel 30. The housing 26 has external retainer tabs 23, 24 and internal retainer tabs 25 which may be formed integrally with the housing 26. The retainer tabs 23, 24, 25 may be formed so as to define a space or slot 19 between the internal retainer tabs 25 and the external retainer tabs 23, 24 that will receive the panel 30. In one embodiment, the housing 26 may include four external retainer tabs 23 and one external retainer tab 24. Two of the external retainer tabs 23 are positioned on an upper surface of the housing 26, and two of the external retainer tabs 23 are positioned on a lower surface of the housing 26. As may be seen in FIGS. 2, 3 and 7, the external retainer tabs 23 on the upper and lower surfaces of the housing 26 are spaced apart. The external retainer tab 24 is located at a leading end 39 of the housing 26. In alternative embodiments of this invention, the external retainer tabs 23 may not be arranged and positioned as are those shown in FIGS. 2, 3 and 7, or the four external retainer tabs 23 may be replaced by two external retainer tabs, one each on the upper and lower surfaces of the housing 26. Other equally satisfactory configurations of the external retainer tabs will become evident to those of ordinary skill in the art.

A plurality of internal retainer tabs 25 is also positioned on the housing 26. The internal retainer tabs 25 are spaced apart from the external retainer tabs 23, 24 to define the slot 19 to accommodate the panel 30 therebetween. In one illustrative embodiment, the six internal retainer tabs 25 are positioned on the housing 26, with three internal retainer tabs 25 being positioned on an upper surface of the housing 26 and three internal retainer tabs 25 being positioned on a lower surface of the housing 26. The three internal retainer tabs 25 on the upper surface of the housing 26 are positioned opposite the three internal retainer tabs 25 on the lower surface of the housing 26 so as to form symmetry of the internal retainer tabs 25 about the plane of the housing 26. The internal retainer tabs 25 have their leading edges chamfered. In one embodiment of the present invention, the internal retainer tabs 25 are staggered so as to not lie immediately opposite the external retainer tabs 23, 24. As pointed out above, the external retainer tabs 23 are spaced apart, and the internal retainer tabs 25 are situated opposite the spaces between the external retainer tabs 23. In the same manner, the internal retainer tabs 25 are spaced apart, and the external retainer tabs 23 are situated opposite the spaces between the internal retainer tabs 25. As in the case of the external retainer tabs 23, the number, spacing and configuration of the internal retainer tabs 25 may be varied within the scope of the present invention. Also, the positioning and orientation of the internal retainer tabs 25 with respect to the external retainer tabs 23 may be varied.

As may be seen in FIGS. 2, 3, 4 and 7, a flexible arm 21 extends from a trailing end 42 of the housing 26, and a tab 22 is formed at the trailing end of the flexible arm 21. As will be described more fully in connection with FIG. 7, the flexible arm 21 and the tab 22 cooperate to limit horizontal movement of the housing 26 in the cutout 31 of the panel 30 when the housing 26 has been inserted into, and slidably positioned within, the cutout 31 in the panel 30. As may also be seen from FIGS. 3 and 4, the external retainer tabs 23, 24 slidably engage the external surface 36 of the panel 30 when the housing 26 is inserted into and slidably positioned in the cutout 31 of the panel 30. Likewise, the internal retainer tabs 25 slidably engage the interior surface 35 of the panel 30 when the housing 26 is inserted into and slidably positioned in the cutout 31 of the panel 30. The engagement of the external retainer tabs 23, 24 with one surface of the panel 30 and the engagement of the internal retainer tabs 25 with the other surface of the panel 30, together with the engagement of the tab 22 with the trailing end of the cutout of the panel 30, serve to slidably retain the connector assembly 20 in the cutout 31 of the panel 30. No additional hardware is required to attach the connector assembly 20 to the panel 30.

Figure 3:
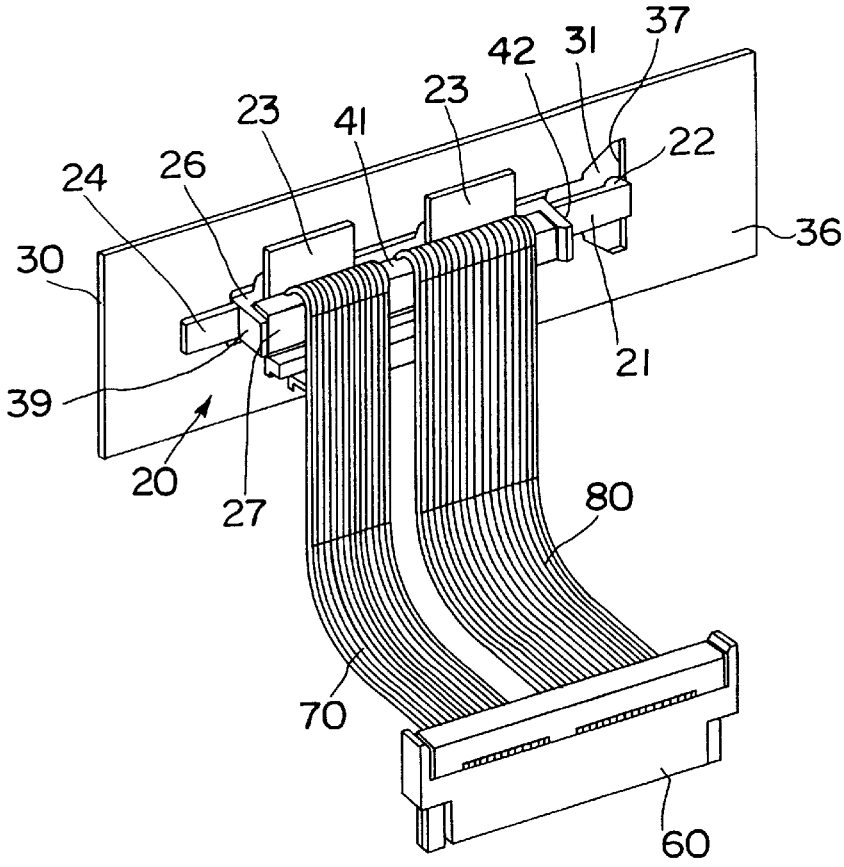
FIG. 3 shows an isometric view from a rear side of a connector assembly according to the present invention mounted in a panel cutout.

FIG. 3 shows the receptacle assembly 20 of FIGS. 1 and 2 viewed from the rear of the assembly 20. FIG. 3 illustrates the receptacle assembly 20 mounted in the panel 30 through the cutout 31. The cutout 31 will be described more specifically in connection with FIG. 5 below. The receptacle assembly 20 includes the external retainer tabs 23, 24 that are adapted to slidably engage the exterior surface 36 of the panel 30 when the housing 26 is inserted into the cutout 31 of the panel 30. As will be explained in greater detail below in connection with FIG. 7, the tab 22 at the end of the flexible arm 21 engages a trailing end 37 of the cutout 31 so as to limit sliding movement of the connector 20 within the cutout 31.

Also shown in FIG. 3 is the manner in which the cables 70 and 80 are oriented with respect to the connector assembly 20. The connector assembly 20 includes contacts having insulation displacement ("IDC") sections (not shown) that are designed to receive a flat cable, such as the cables 70, 80 and interconnect with the individual electrical connectors in the flat cable. Contacts with IDC sections are known to those of ordinary skill in the art of electrical connectors. A locking cover 27 assists in interconnecting the conductors of the cables 70 and 80 with the IDC sections and provides for cable strain relief. The cables 70, 80 are clamped between the housing 26 and the locking cover 27 to ensure termination of the conductors of each cable 70, 80 with the IDC sections in the housing 26. The cables 70, 80 exit from the housing 26 and locking cover 27 by looping over an upper edge 41 of the locking cover 27, as shown in FIG. 2. By looping the cables 70, 80 over the upper edge 41 of the locking cover 27 and then turning them downward toward the lower edge of the locking cover 27, the engagement between the cables 70, 80 and the IDC sections is better ensured and is afforded an added measure of strain relief.

Figure 4:
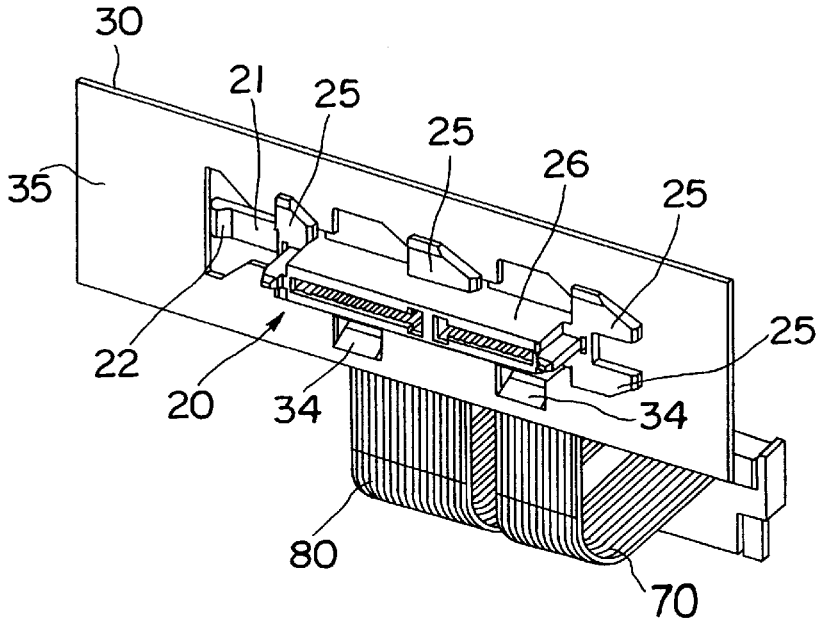
FIG. 4 shows an isometric view from a front side of a connector assembly according to the present invention mounted in a panel cutout.

Referring now to FIG. 4, the plurality of internal retainer tabs 25 is positioned on the housing 26. The internal retainer tabs 25 are adapted to slidably engage the internal surface 35 of the panel 30 when the housing 26 is inserted into the cutout 31 of the panel 30. When the housing 26 is inserted into the cutout 31, the panel 30 is received in the slot 19 formed between the external retainer tabs 23, 24 and the internal retainer tabs 25. The connector 20 may slide along the panel 30 within the cutout 31, limited by the tab 22 and the flexible arm 21. FIG. 3 also illustrates steps 34 formed at the edge of the cutout 31 that cooperate with a spring assembly 29 to position the connector 20 at or near the vertical mid-point of the cutout 31 in a normal resting position. Further detail of the steps 34 and their cooperation with the spring assembly 29 will be set forth in connection with the discussion of FIG. 7 below.

Figure 5:
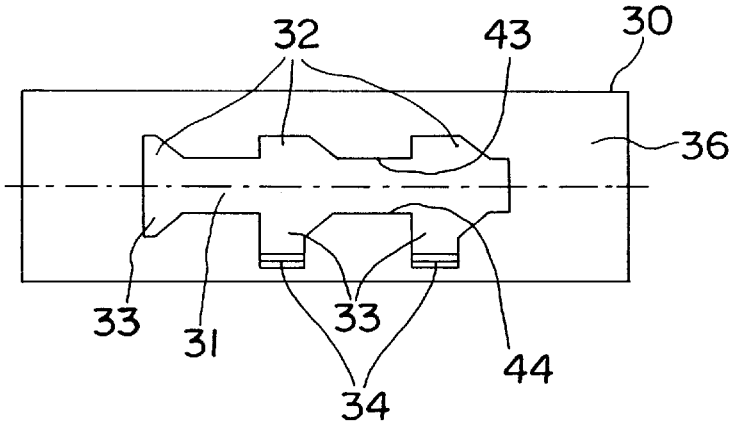
FIG. 5 shows a panel cutout that may receive a housing of a connector according to the present invention.

FIG. 5 shows one illustrative embodiment of a cutout 31 in the panel 30 (shown from its exterior surface 36) that is adapted to receive the connector housing shown in FIGS. 2, 3 and 4. As shown, the cutout 31 has a plurality of recesses 32, 33 that are similar in configuration to the configuration of the internal retainer tabs 25 on the housing 26, shown in FIGS. 2, 3 and 4. The recesses 32 may be located on an upper edge 43 of the cutout 31, and they are adapted to receive the internal retainer tabs 25 that are positioned on the upper edge of the housing 26. The recesses 33 may be located on a lower edge 44 of the cutout 31, and they are adapted to receive the internal retainer tabs 25 that are positioned on the lower edge of the housing 26. The similarity in the configuration of the recesses 32, 33 and the internal retainer tabs 25 facilitates the passage of the internal retainer tabs 25 through the cutout 31 for installation of the connector assembly 20 into the cutout 31.

The cutout 31 includes the steps 34 positioned at a lower edge of two of the recesses 33. These steps 34 will be described more fully in connection with FIGS. 6 and 7. The steps 34, in the embodiment described herein, are integral with the panel 30, in that the panel 30 is constructed of metal, and the steps 34 are formed by bending a portion of the metal outwardly, toward the external surface 36 of the panel 30. As will be seen below, these steps 34 are adapted to engage a leaf spring 29 (shown in FIG. 7) or other resilient device that enables centering of the connector assembly 20 within the cutout 31.

Figure 6:
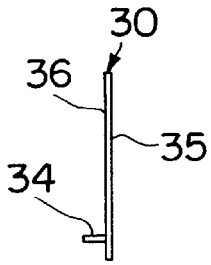
FIG. 6 is a cross-section view of a panel at the cutout showing steps integrally formed therewith.

FIG. 6 is a cross-section view of the panel 30 at the cutout 31. The steps 34 are seen protruding from the external surface 36 of the panel 30. In the particular embodiment illustrated, the steps 34 protrude from the external surface 36 of the panel 30 approximately 3.5 mm. As already mentioned, the steps 34 are formed by bending portions of the metal panel 30 outwardly toward the exterior surface 36 of the panel 30. In an embodiment in which the panel 30 is of another material, for example, plastic, the steps 34 may be formed with the panel 30 and cutout 31. Other ways of creating the steps 34 will be evident to those of ordinary skill in view of the particular material used for the panel 30.

Figure 7:
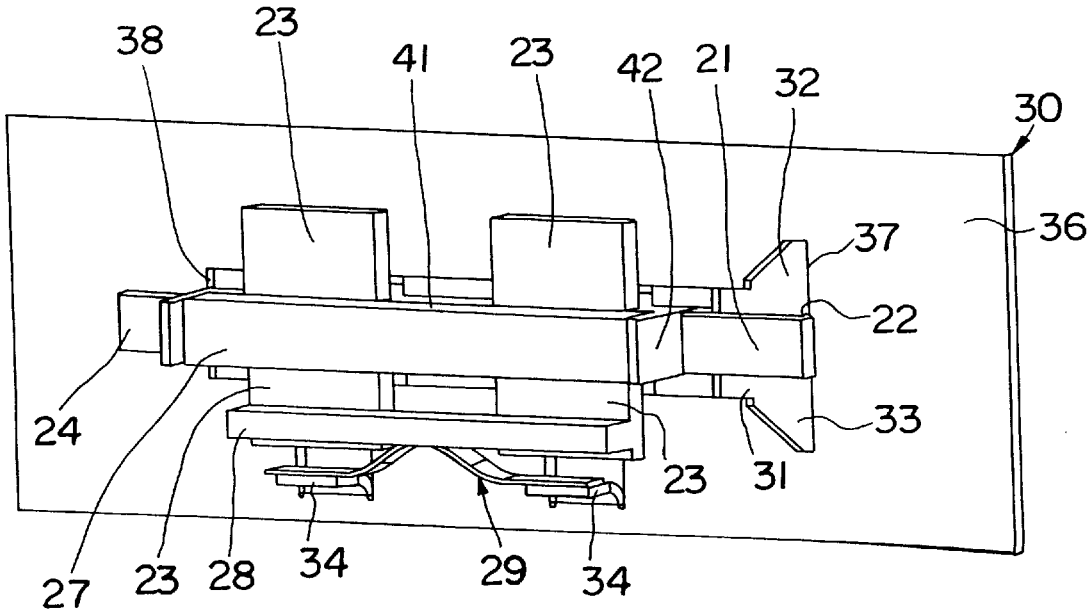
FIG. 7 is elevation view of a connector receptacle assembly, without cable, in place in a panel cutout in accordance with the present invention.

FIG. 7 shows the connector assembly 20 of FIGS. 2, 3 and 4 properly positioned in the panel 30 through the cutout 31. The connector assembly 20 and the panel 30 are shown from the external surface 36 of the panel 30. As is evident from FIG. 7, the housing 26 has been positioned in the cutout 31 by first inserting the housing 26 through that portion of the cutout 31 nearest its trailing edge 37 and then sliding the housing 26 toward the leading edge 38 of the cutout 31. As the housing 26 is first inserted through the cutout 31 at the trailing edge 37, the internal retainer tabs 25 on the housing 26 pass through the recesses 32, 33 of the cutout 31, whereas the external retainer tabs 23, 24 will not pass through the recesses 32, 33 in the cutout 31. The gap between the internal and external retainer tabs 25 and 23, 24 on the housing 26 will receive the panel 30, and the housing 26 may be slidably urged toward the leading edge 38 of the cutout 31. As the housing 26 is moved toward the leading edge 38 of the cutout 31, the internal retainer tabs 25 slidably engage the interior surface 35 of the panel 30 and the external retainer tabs 23, 24 slidably engage the exterior surface 36 of the panel 30. When the housing 26 has been moved sufficiently close to the leading edge 38 of the cutout 31, the flexible arm 21 is biased so as to urge the tab 22 into engagement with the trailing edge 37 of the cutout 31. Although additional movement of the housing 26 toward the leading edge 38 of the cutout 31 may be possible, and even desirable, movement of the housing 26 toward the edge 37 of the cutout 31 will be limited by the tab 22 acting in concert with the flexible arm 21.

FIG. 7 also illustrates a mechanism for centering the connector assembly 20 in the cutout 31 of the panel 30. As is evident from FIG. 7, the vertical height of the cutout 31 in the panel 30 is greater than the height of the housing 26 of the connector assembly 20. The difference in these heights accommodates a vertical misalignment between the connector assembly 20 and a mating plug assembly on a component 10 (see FIG. 1) that is intended for engagement with the assembly 20. In the embodiment described herein and illustrated in the Figures, the panel cutout 31 is designed to allow for 3.3 mm of float in the vertical direction. When the connector assembly 20 is properly positioned in the panel 30 but before a component 10 is positioned into engagement with the assembly 20, the assembly is preferably maintained in a centered position with respect to the cutout 31 so as to be better able to receive and interconnect with a mating plug assembly on the component 10 when it is installed. The connector assembly 20 is designed such that the receptacle and plug assemblies can mate if they are misaligned up to 1.975 mm in the vertical direction. The connector assembly 20 is held in the center of the cutout 31 to ensure that it can mate with a plug assembly which is at an extreme of the limit of its tolerance.

In the assembly embodiment shown in FIG. 7, a ledge 28 is integrally formed with the two lower external retainer tabs 23. The ledge 28 extends rearwardly and is adapted to receive and be affixed to, on its lower surface, a center portion of a leaf spring 29. The leaf spring 29 may be affixed to the lower surface of the ledge 28 by any suitable means, including but not limited to, a liquid adhesive, a rivet or screw, retaining tabs or fingers formed integrally with the ledge 28, or other suitable means. The leaf spring 29 has two ends that rest on the steps 34 when the connector assembly 20 is at or below the midpoint of the cutout 31 of the panel 30. Thus, the assembly 20 is maintained in a resting, vertically centered position before a component 10 is positioned to engage the assembly 20. When a mating plug assembly on a component is moved into sliding engagement with the connector assembly 20, the assembly 20 is free to move upwardly to receive the component 10 as well as move downwardly to receive the component 10. Movement downwardly by the connector assembly 20 will act against biasing forces of the leaf spring 29 on the steps 34 but will be permitted. If the connector assembly 20 and the component 10 are misaligned such that the connector assembly 20 must move upwardly, engagement between the connector assembly 20 and the component 10 will be facilitated because the connector assembly 20 began from a centered, rather than an extreme lower, position. Thus, greater vertical movement by the connector assembly 20 is made possible because of the vertical centering mechanism without sacrificing tolerances needed to ensure proper make-up.

As will be appreciated, the leaf spring 29 may be replaced with any suitable resilient member with equal advantage. For example, a coil spring may be positioned above or below the connector to bias the connector to a resting, centered position in the cutout 31. Other resilient devices may also be used to center the connector in the output 31.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A connector assembly, comprising:

a housing having electrical contacts adapted for interconnection with an electrical cable, the housing adapted for mounting to a panel through a cutout in the panel, the housing being adapted for insertion into the cutout followed by sliding movement relative to the panel in a first direction to retain the housing in the cutout;

a resilient member between the housing and the panel to bias the housing toward a centered position within the cutout;

the housing while being retained in the cutout further being adapted for sliding movement relative to the panel in a second direction against a bias provided by the resilient member; and the cutout being larger than the housing permitting sliding movement of the housing relative to the panel in a third direction that is opposite the second direction while the housing is retained in the cutout.

2. The connector assembly of claim 1, further comprising:

a retention arm adapted to releasably engage an edge of the cutout in the panel, following sliding movement of the housing in said first direction, to limit sliding movement of the housing relative to the panel in a fourth direction that is opposite to the first direction.

3. A connector assembly, comprising:

a housing having electrical contacts adapted for interconnection with an electrical cable, the housing being adapted for mounting to a panel through a cutout in the panel, the housing being adapted for insertion into the cutout and for sliding engagement with the panel to retain the housing in the cutout;

centering means coupled to the housing and adapted to substantially vertically center the housing in the cutout when the connector is unmated with a complementary connector;

at least one interior retainer tab coupled to the housing and adapted for insertion through the cutout and for sliding engagement with a first surface of the panel; and at least one exterior retainer tab coupled to the housing and adapted for sliding engagement with a second surface of the panel;

the interior and exterior retainer tabs positioned to capture the panel therebetween to retain the connector in the cutout during vertical and horizontal sliding movement of the connector in the cutout.

4. The connector of claim 3, wherein the housing has a leading edge and a trailing edge, the connector further comprising a flexible arm coupled to the housing, the flexible arm having a tab positioned thereon, the flexible arm and tab adapted to limit horizontal movement of the housing with respect to the cutout.

5. The connector of claim 4, further comprising a locking cover adapted to capture the electrical cable between the locking cover and the electrical contacts to facilitate electrical connection between the cable and the electrical connectors, and wherein the cable is adapted to loop over the locking cover of the connector.

6. A connector, comprising:

a housing;

a first set of retainer tabs coupled to the housing and adapted for sliding engagement with a first surface of a panel;

a second set of retainer tabs coupled to the housing and adapted for sliding engagement with a second surface of the panel, the first and second sets of retainer tabs forming a gap therebetween adapted to receive the panel for mounting the housing; and a spring coupled to the housing and adapted to cooperate with the panel for substantially vertically centering the housing in a cutout of the panel.

7. The connector of claim 6, wherein the housing has a leading edge and a trailing edge, the connector further comprising a flexible arm coupled at a first end to the trailing edge of the housing and a tab coupled to a second end of the flexible arm, the housing adapted for horizontal sliding engagement with the panel while the housing is in the cutout, the flexible arm and tab adapted to limit horizontal movement of the housing with respect to the cutout.

8. The connector of claim 7, wherein the spring is adapted to abut at least a first step on the panel when a vertical midpoint of the connector is below a vertical midpoint of the cutout.

9. The connector of claim 8, further comprising a locking cover adapted to capture a first end of an electrical cable between the locking cover and the housing, and the housing and locking cover are adapted to permit the cable to loop over the locking cover of the connector.

10. The connector of claim 6, further comprising a locking cover adapted to couple to the housing and capture a first end of a cable between the locking cover and the housing.

11. The connector of claim 10, wherein the housing and cover are adapted to permit the cable to loop over the locking cover when the first end of the cable is captured between the locking cover and the housing.

12. The connector of claim 6, wherein the spring is adapted to abut at least a first step on the panel when a vertical midpoint of the connector is below a vertical midpoint of the cutout.

13. The connector of claim 12, further comprising a locking cover adapted to capture a first end of an electrical cable between the locking cover and the housing, the cable adapted to loop over the locking cover.

14. A connector assembly, comprising:

a panel having a cutout, the cutout having a first cutout dimension and a second cutout dimension;

a connector housing adapted for insertion into the cutout, the housing having a first housing dimension that is less than the first cutout dimension and a second housing dimension that is less than the second cutout dimension;

a first set of retainer tabs coupled to the housing and adapted for insertion into the cutout, the first set of retainer tabs adapted for sliding engagement with a first surface of the panel;

a second set of retainer tabs coupled to the housing, the second set of retainer tabs adapted for sliding engagement with a second surface of the panel, the first and second sets of retainer tabs forming a gap therebetween to receive the panel when the housing and first set of retainer tabs are inserted into the cutout, the first and second sets of retainer tabs cooperating to retain the housing in the cutout;

a resilient device coupled to the housing and adapted to cooperate with the panel to center the housing in the cutout in the first cutout dimension; and a locking cover adapted to couple to the housing and thereby capture a first end of a cable between the locking cover and the housing.

15. The connector assembly of claim 14, further comprising a flexible arm and tab coupled to the housing, the flexible arm adapted to urge the tab into locking engagement with a first end of the cutout to limit horizontal movement of the housing in the cutout.

16. The connector assembly of claim 15, wherein the centering device comprises a spring coupled to the housing and adapted to abut at least a first step on the panel to substantially center the connector in the first cutout dimension when the connector is unmated to a complementary connector.

* * * * *